US008663041B1

(12) United States Patent
Gryspeerd

(10) Patent No.: US 8,663,041 B1
(45) Date of Patent: Mar. 4, 2014

(54) TECHNOLOGIES FOR ARCHERY

(71) Applicant: David Gryspeerd, Chesterfield, MI (US)

(72) Inventor: David Gryspeerd, Chesterfield, MI (US)

( * ) Notice: Subject to any disclaimer, the term of this patent is extended or adjusted under 35 U.S.C. 154(b) by 0 days.

(21) Appl. No.: 13/970,823

(22) Filed: Aug. 20, 2013

Related U.S. Application Data

(63) Continuation-in-part of application No. 13/745,984, filed on Jan. 21, 2013.

(51) Int. Cl.
*F42B 6/08* (2006.01)

(52) U.S. Cl.
USPC ..... 473/582; 473/583

(58) Field of Classification Search
USPC ..... 473/578, 582, 583
See application file for complete search history.

(56) References Cited

U.S. PATENT DOCUMENTS

| | | | | |
|---|---|---|---|---|
| 2,691,527 | A * | 10/1954 | Ramsey | 473/583 |
| 2,820,637 | A * | 1/1958 | La Foud | 473/583 |
| 4,254,958 | A * | 3/1981 | Bateman, III | 473/583 |
| 4,405,133 | A * | 9/1983 | Cartwright, Jr. | 473/582 |
| 5,145,186 | A | 9/1992 | Maleski | |
| 6,283,880 | B1 | 9/2001 | Barrie | |
| 7,374,505 | B2 | 5/2008 | Polando | |
| 7,651,421 | B2 | 1/2010 | Smith et al. | |
| 8,016,703 | B1 | 9/2011 | Kronengold et al. | |
| 8,057,330 | B2 | 11/2011 | Blosser et al. | |
| D659,218 | S | 5/2012 | Palomaki et al. | |
| 2009/0163308 | A1 | 6/2009 | Odabachian et al. | |

OTHER PUBLICATIONS

Pat Norris Archery Online Catalog www.patnorrisarchery.com/catalog/images/sg/5315.jpg Jan. 8, 2013.

Cabela's: Adder Points Zoom Cabela's Online Catalog www.cabelas.com/catalog/largeImagePopup.jsp?productId=744846 Jan. 8, 2013.

* cited by examiner

*Primary Examiner* — John Ricci
(74) *Attorney, Agent, or Firm* — Goldstein Law Offices, P.C.

(57) ABSTRACT

A device for use in archery. The device includes a cap defined via a plate and a skirt depending from the plate. The plate has a hole therethrough. The hole is sized such that a coupling shank is able to pass therethrough. The device further includes a spine depending from the skirt. The device also includes a fin extending from the spine.

20 Claims, 8 Drawing Sheets

TECHNOLOGIES FOR ARCHERY

CROSS-REFERENCE TO RELATED APPLICATIONS

The present application is a continuation-in-part (CIP) of U.S. patent application Ser. No. 13/745,984, filed on Jan. 21, 2013, which is fully incorporated by reference for all purposes.

TECHNICAL FIELD

Generally, the present disclosure relates to archery. More particularly, the present disclosure relates to arrows.

BACKGROUND

In the present disclosure, where a document, an act and/or an item of knowledge is referred to and/or discussed, whether directly and/or indirectly, this reference and/or discussion is not an admission that the document, the act and/or the item of knowledge and/or any combination thereof was at the priority date, publicly available, known to the public, part of common general knowledge and/or otherwise constitutes prior art under the applicable statutory provisions and/or is known to be relevant to an attempt to solve any problem with which the present disclosure is concerned.

Archery involves an archer operating a bow/crossbow to propel an arrow for entertainment, sports, hunting and/or combat purposes. The arrow includes an arrowhead, such as a broadhead, and an arrow shaft coupled to the arrowhead. Such coupling can be performed in several ways.

One of such ways involves the arrowhead having a shank and the arrow shaft having an open end. The arrowhead is coupled to the arrow shaft when the shank is inserted into the open end. When the shank and/or the open end are correspondingly threaded, then the shank can be screwed into the open end and/or vice versa.

Another one of such ways involves the arrowhead having the open end and the arrow shaft having the shank. The arrowhead is coupled to the arrow shaft when the shank is inserted into the open end. When the shank and/or the open end are correspondingly threaded, then the shank can be screwed into the open end and/or vice versa.

Regardless of how the arrowhead is coupled to the arrow shaft, many hunters use broadhead arrows when hunting for prey. However, such hunts become more difficult when the prey possess small vital areas, keen eyesight, natural wariness and/or rapid mobility. For example, when a wild turkey is hit with a broadhead arrow, then the wounded turkey is often still able to dash and/or hide in nearby bushes/thick brush, fly away and/or run away so that the hunter is unable to catch up to the turkey in order to recover the turkey. Also, when the wounded turkey runs away from the hunter, the turkey often leaves little tracks and/or blood trail for the hunter to follow. Moreover, the turkey can escape with the hunter's arrow, which can be costly. Overall, such occurrences can be generally traced to the broadhead arrow insufficiently damaging the turkey's vital organs upon impact and/or passing fully through the turkey's torso.

In order to reduce at least one of such occurrences, some hunters attempt to quickly immobilize, severely injure and/or instantly kill the turkey via coupling specialized devices to the arrows that reduce arrow penetration, which results in more internal organ/tissue damage and/or greater shock to the turkey. Other hunters use mechanically expandable broadheads and/or place forward-facing serrated edges on the broadheads, which similarly results in reduced arrow penetration, increased tissue/organ damage and/or greater shock to the turkey. However, such approaches can demand specialized equipment and/or adversely impact arrow aerodynamics.

While certain aspects of conventional technologies have been discussed to facilitate the present disclosure, no technical aspects are disclaimed. The claims may encompass one and/or more of the conventional technical aspects discussed herein.

BRIEF SUMMARY

The present disclosure addresses at least one of the above. However, the present disclosure may prove useful in addressing other problems and/or deficiencies in a number of technical areas. Therefore, the claims, as recited below, should not be necessarily construed as limited to addressing any of the particular problems and/or deficiencies discussed herein.

According to an example embodiment of the present disclosure a device for use in archery is provided. The device includes a cap defined via a plate and a skirt depending from the plate. The plate has a hole therethrough. The hole is sized such that a coupling shank is able to pass therethrough. The device further includes a spine depending from the skirt. The device also includes a fin extending from the spine.

According to another example embodiment of the present disclosure a device for use in archery is provided. The device includes a cap defined via a plate and a skirt depending from the plate. The plate has a hole therethrough. The hole is sized such that a coupling shank is able to pass therethrough. The device further includes a plurality of spines depending from the skirt. The device also includes a plurality of fin sets uniquely corresponding to the skirts. The sets extend from the skirts.

According to yet another example embodiment of the present disclosure a method of manufacturing a device for use in archery is provided. The method includes defining a cap via a plate and a skirt depending from the plate. The method further includes forming a hole through the plate. The hole is sized such that a coupling shank is able to pass therethrough. The method also includes depending a spine from the skirt. The method additionally includes extending a fin from the spine.

The present disclosure may be embodied in the form illustrated in the accompanying drawings. Attention is called to the fact, however, that the drawings are illustrative. Variations are contemplated as being part of the disclosure, limited only by the scope of the claims.

BRIEF DESCRIPTION OF THE DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

DETAILED DESCRIPTION OF THE PREFERRED EMBODIMENTS

Figure 1A:
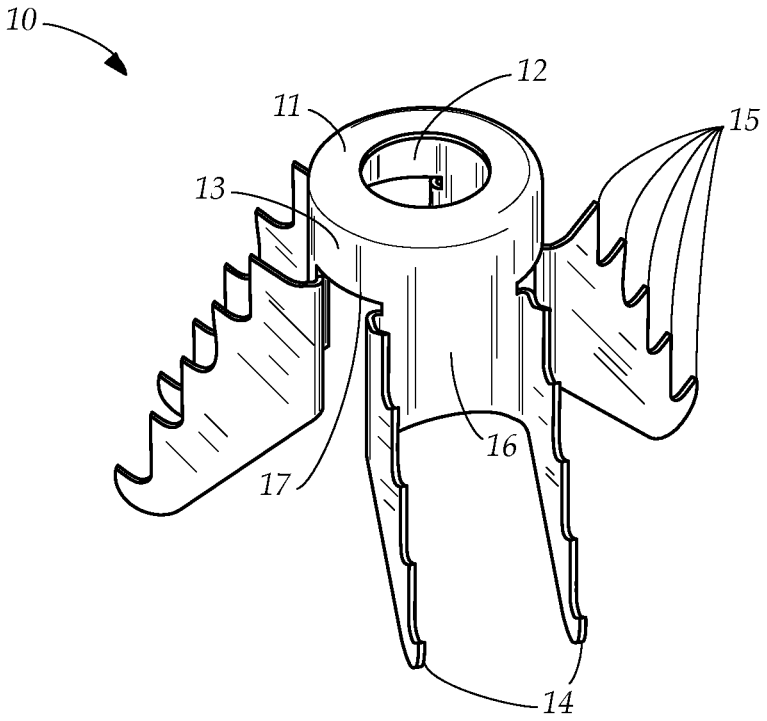
FIG. 1A shows a perspective view of an example embodiment of an arrow accessory according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments set forth herein. Rather, these example embodiments are provided so that the disclosure is thorough and complete, and fully conveys the concepts of the present disclosure to those skilled in the art. Also, features described with respect to certain example embodiments may be combined in and/or with various other example embodiments. Different aspects and/or elements of example embodiments, as disclosed herein, may be combined in a similar manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography, and so forth.

Any and/or all elements, as disclosed herein, can include, whether partially and/or fully, a solid, including a metal, a mineral, an amorphous material, a ceramic, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

FIG. 1A shows a perspective view of an example embodiment of an arrow accessory according to the present disclosure.

An accessory 10 has a plate 11. Plate 11 can be rigid, flexible and/or any combination thereof. Plate 11 can be even leveled, non-even leveled and/or any combination thereof. Plate 11 can have a circular, oval, square, triangular, rectangular, trapezoidal, pentagonal and/or any other shape. Plate 11 can include metal, plastic, rubber, wood and/or any other materials. Plate 11 can be domed outward, domed inward, and/or any combination thereof. Plate 11 can be smooth, non-smooth and/or any combination thereof.

Plate 11 has a hole 12 therethrough. Hole 12 is sized such that a coupling shank, such as an arrowhead shank and/or an arrow shaft shank, is able to pass therethrough. Hole 12 can have a circular, oval, square, triangular, rectangular, trapezoidal, pentagonal and/or any other shape.

A skirt 13 depends from plate 11. Skirt 13 can partially and/or fully depend from plate 11. Skirt 13 can partially and/or fully depend from the periphery of plate 11. In another example embodiment, skirt 13 partially and/or fully depends from non-periphery areas of plate 11. For example, such dependency can allow for lips, irrespective of size, on plate 11. For instance, skirt 13 can depend from plate 11 such that skirt 13 and plate are in T-relationship with each other or inverse L-relationship with each other. In some example embodiments, skirt 13 can depend from plate 11 in order to be relatively snug with an arrow shaft. However, in other example embodiments, skirt 13 can depend from plate 11 in order to be relatively away from the arrow shaft so to avoid being snug with the arrow shaft. Skirt 13 can include metal, plastic, rubber, wood and/or any other materials. Skirt 13 can have a linear bottom edge and/or a non-linear bottom edge, such as wavy, zigzagged and/or any other. Skirt 13 can be smooth and/or non-smooth. Skirt 13 can be rigid, flexible and/or any combination thereof. Skirt 13 can have a height equal or non-equal to diameter of plate 11, whether greater or lesser. In another embodiment, accessory 10 lacks skirt 13.

Skirt 13 can depend from plate 11 in an aligned, non-aligned, linear, non-linear, angled manner and/or any combination thereof. Skirt 13 can be perpendicular to plate 12, incline inward such that skirt 13 is at least partially overlaid via plate 12, incline outward such that skirt 13 is not at least partially overlaid via plate 12, and/or any combination thereof.

A plurality of fins 14 downwardly depends from skirt 13. Fins 14 have a plurality of forward-facing serrated edges, as defined via teeth 15. Fins 14 can include metal, plastic, rubber, wood and/or any other materials. Fins 14 can be rigid, flexible and/or any combination thereof. Any portion or edge of fins 14 can be can be smooth, non-smooth and/or any combination thereof. Fins 14 can partially and/or fully depend from skirt 13. Such depending can be aligned, non-aligned, linear, non-linear, angled and/or any combination thereof. All fins 14 can be identical, whether in size, weight and/or properties, to each other, different from each other, even within a fin set and/or a single fin, and/or any combination thereof. Fins 14 can be organized into sets, such as pairs, triplets and/or others. Within each such set, at least two of fins 14 can be parallel or non-parallel, whether convergent and/or divergent, to each other. Any amount of fin sets 14 can be used, such as two, three, four, five, six, and so forth. As shown in FIG. 1A, accessory 10 includes three fin sets 14. Fin sets 14 can be set for aerodynamic balancing. The forward-facing edges can be aligned and/or angled, whether diverging and/or converging to each other and/or toward the arrowhead and/or the arrow shaft. In another example embodiment, a set of fins 14, such as a pair of parallel fins 14, can have another fin 14 across and/or in-between, such as in a perpendicular and/or non-perpendicular manner, like diagonal.

Fins 14 have teeth 15, which can include metal, plastic, rubber, wood and/or any other materials. There can be any number of teeth 15, such as two, three, five, fifty, and so forth. Teeth 15 can be rigid, flexible and/or any combination thereof. Teeth 15 can be can be smooth, non-smooth and/or any combination thereof. Whether in size, weight and/or properties, all teeth 15 on each and/or other fins 14 can be identical to each other, different from each other, even within a fin set and/or a single fin, and/or any combination thereof. At least some and/or all teeth 15 can be sharp at least for hunting, dull and/or any combination thereof. Some and/or all teeth 15 can be serrated in one pattern having many sub-patterns, one identical pattern, different patterns and/or any combinations thereof. Fin sets 14 can be serrated identically to each other and/or differently from each other and/or any combination thereof. Teeth 15 can be sharpened pre-use and/or post-use. In other example embodiments, fins 14 can also include serrated rear-facing edges, which can be serrated identical to and/or different from teeth 15 in any manner as disclosed herein. One of teeth 15 can include several teeth and/or sub-teeth. Any of teeth 15 can be rounded, sharply peaked, spiked, wavy and/or any combination thereof.

Skirt 13 includes a spine 16 downwardly depending from skirt 13. Such depending can be aligned, misaligned, linear, non-linear, angled and/or any combination thereof. At least some of fins 14 can extend from spine 16. Spine 16 can be coplanar with skirt 13, perpendicular to plate 11, incline inward such that spine 16 is at least partially overlaid via plate 12, incline outward such that spine 16 is not at least partially overlaid via plate 12, and/or any combination thereof. Spine 16 can partially and/or fully depend from plate 13. Spine 16 depends from the bottom edge of skirt 13. In another example embodiment, skirt 13 depends from the non-bottom edge of skirt 13, such as above the bottom edge. Spine 16 can include metal, plastic, rubber, wood and/or any other materials. Spine 16 can have a linear bottom edge and/or a non-linear bottom edge, such as wavy, zigzagged and/or any other. Spine 16 can be smooth and/or non-smooth. Spine 16 can be rigid, flexible and/or any combination thereof. Although in one embodiment, plate 11, skirt 13, spine 16 and at least two of fins 14, including teeth 15, are unitary, in another embodiment, plate 11, skirt 13, spine 16 and at least two of fins 14, including teeth 15, are assembled into accessory 10. Whether in size, weight and/or properties, at least some and/or all spines 16 can be identical to each other, different from each other, even for a fin set, and/or any combination thereof. Spine 16 can have a height identical to or different from skirt 13. In another embodiment, accessory 10 lacks spine 16.

Skirt 13 has a portion 17 where skirt 13 lacks spine 16 depending therefrom. Portion 17 portion is located between two fin sets 14. In one example embodiment, at least some of fin 14 when organized into sets, can have such sets being angled less than 180 degrees from each other. Such angles can be 60 degrees, 90 degrees, 120 degrees and others. Such angles can all be equal, different and/or any combination thereof. In other embodiments, at least some of fin 14, when organized into sets, can have those sets being angled greater than 180 degrees from each other.

Figure 1B:
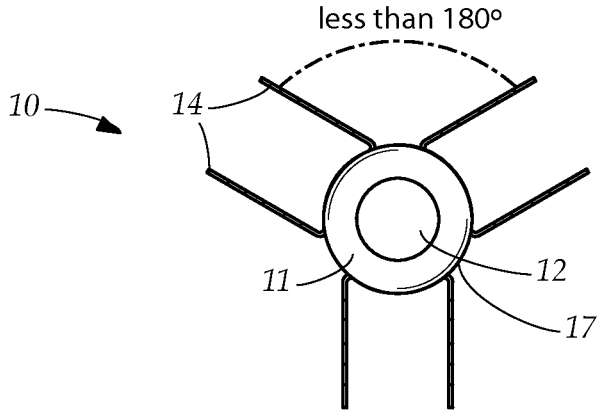
FIG. 1B shows a top view of an example embodiment of an arrow accessory according to the present disclosure.

FIG. 1B shows a top view of an example embodiment of an arrow accessory according to the present disclosure. Some elements of this figure are described above. Thus, same and/or similar reference characters identify same and/or like components described above and any repetitive detailed description thereof will hereinafter be omitted or simplified in order to avoid complication.

At least some of fins 14 are organized into sets. Such sets can be angled less than 180 degrees from each other. Such angles can be 60 degrees, 90 degrees, 120 degrees and others. Such angles can all be equal, different and/or any combination thereof. For example, three fin sets 14 can be equally angled at 120 degrees therebetween.

Figure 2A:
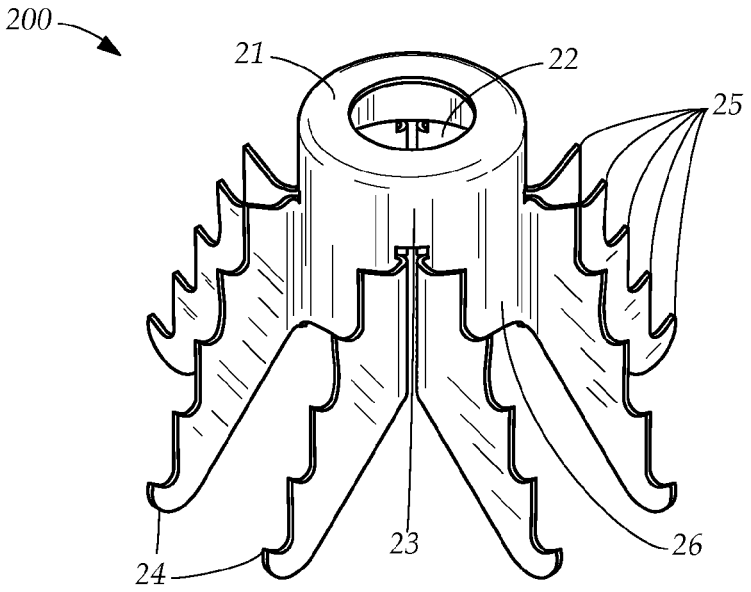
FIG. 2A shows a perspective view of an example embodiment of an arrow accessory according to the present disclosure.

FIG. 2A shows a perspective view of an example embodiment of an arrow accessory according to the present disclosure. Some elements of this figure are described above. Thus, same and/or similar reference characters identify same and/or like components described above and any repetitive detailed description thereof will hereinafter be omitted or simplified in order to avoid complication.

Accessory 20 includes four fin sets 24.

Figure 2B:
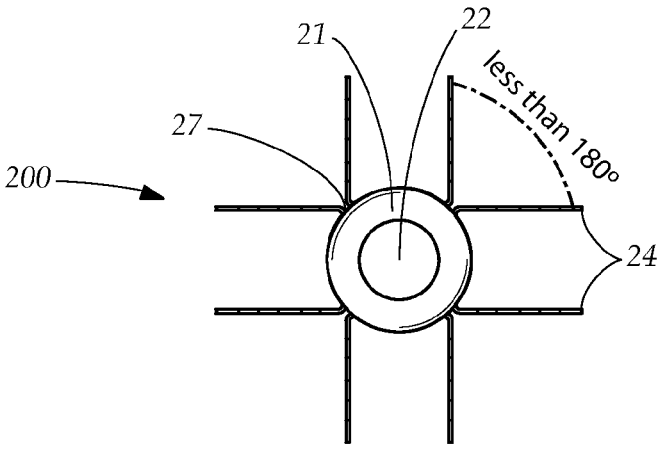
FIG. 2B shows a top view of an example embodiment of an arrow accessory according to the present disclosure.

FIG. 2B shows a top view of an example embodiment of an arrow accessory according to the present disclosure. Some elements of this figure are described above. Thus, same and/or similar reference characters identify same and/or like components described above and any repetitive detailed description thereof will hereinafter be omitted or simplified in order to avoid complication.

Portion 27, which can be identical to and/or different from to portion 17, is smaller in circumference than portion 17, although portion 27 can also be larger in circumference than portion 17 in other embodiments. Also, four fin sets 14 are equally angled at 90 degrees therebetween.

Figure 3:
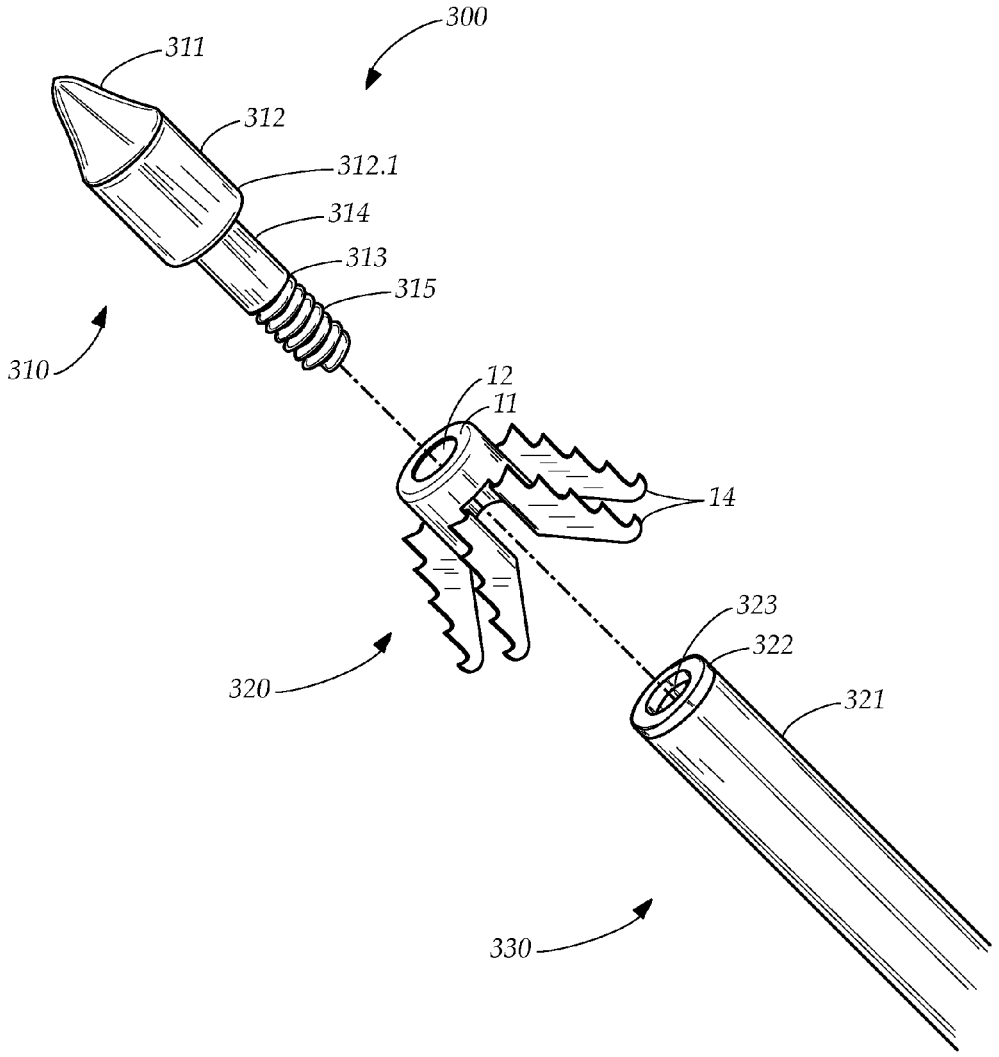
FIG. 3 shows a perspective view of an example embodiment of an unassembled arrow before use with an arrow accessory according to the present disclosure.

FIG. 3 shows a perspective view of an example embodiment of an unassembled arrow before use with an arrow accessory according to the present disclosure. Some elements of this figure are described above. Thus, same and/or similar reference characters identify same and/or like components described above and any repetitive detailed description thereof will hereinafter be omitted or simplified in order to avoid complication.

An accessory 320, which can be like accessory 10 and/or 200 described above, can be used with an arrow 300 having an arrowhead 310 and an arrow shaft 330. Accessory 320, which can be handheld, can be operative for single use, multiple uses and/or any combinations thereof. Accessory 320 and/or any component/sub-component thereof can be smaller than 5 inches in any manner.

Arrow 300 can be used with a bow and/or a crossbow. Arrow 300 can be used for any purpose, such as entertainment, sports, hunting and/or combat. Any portion and/or any component/sub-component of arrow 300 can include metal, plastic, rubber, wood and/or any other materials. Any portion and/or any component/sub-component of arrow 300 can have a circular, oval, square, triangular, rectangular, trapezoidal, pentagonal and/or any other cross-section.

Arrowhead 310 includes an arrowhead tip 311 and an arrowhead body 312. Tip 311 can include metal, plastic, rubber, wood and/or any other materials. Tip 311 can be sharp, dull and/or any combination thereof. Tip 311 can be smooth, non-smooth and/or any combination thereof. Tip 311 can be unitary, assembled and/or any combination thereof. Tip 311 can be rigid, flexible and/or any combination thereof. Tip 311 can be used for entertainment, sports, hunting and/or combat.

Body 312 can include metal, plastic, rubber, wood and/or any other materials. Body 312 can be sharp, dull and/or any combination thereof. Body 312 can be smooth, non-smooth and/or any combination thereof. Body 312 can be unitary, assembled and/or any combination thereof. Body 312 can be rigid, flexible and/or any combination thereof. Body 312 can be used for entertainment, sports, hunting and/or combat. Tip 311 and body 312 can be unitary, assembled and/or any combination thereof. Body 312 includes a base 312.1 which can come in contact with plate 11.

Arrowhead 310 has a shank 313 extending therefrom. Shank 313 can include metal, plastic, rubber, wood and/or any other materials. Shank 313 can be smooth, non-smooth and/or any combination thereof. Shank 313 can be unitary, assembled and/or any combination thereof. Shank 313 can be rigid, flexible and/or any combination thereof. Shank 313 can be used for entertainment, sports, hunting and/or combat. Shank 313, tip 311 and/or body 312 can be unitary, assembled and/or any combination thereof. Shank 313 includes a non-threaded portion 314 and/or a threaded portion 315, any of which can be structured as described herein.

Arrowhead 310 can be of any type, such as a broadhead, a bodkin point, a blunt, a judo point, a target point, a field point and/or a safety arrow. Arrowhead 310 can be hollow, solid and/or any combination thereof. Arrowhead 310 can include metal, plastic, rubber, wood and/or any other materials. Arrowhead 310 can have a circular, oval, square, rectangular, trapezoidal, pentagonal and/or any other cross-section.

Shaft 330 includes a body 321 and an open end 322. Body 321 can be hollow, solid and/or any combination thereof. Body 321 can include metal, plastic, rubber, wood and/or any other materials. Body 321 can have a circular, oval, square, triangular, rectangular, trapezoidal, pentagonal and/or any other cross-section. Body 321 can be unitary, assembled and/or any combination thereof.

Open end 322 is operative to receive shank 313 via a hole 323, which can be a circular, oval, square, triangular, rectangular, trapezoidal, pentagonal and/or any combination thereof. Shank 313 can be coupled to shaft 330 via open end 322 in many ways, such as fastening, mating, threading, pressure, magnets, adhesives and/or any other coupling way. Open end 322 can include metal, plastic, rubber, wood and/or any other materials. Fins 14 can be positioned over shaft 321 further than skirt 13. Shank 313 includes threaded portion 315 and shaft 330 is corresponding threaded within. Consequently, shank 313 is passed through hole 12 of accessory 320 into open end 322 via hole 323 and screwed, via threading, into shaft 330 and/or vice versa.

Note that in other example embodiments, a reversed configuration is possible where shaft 330 includes shank 313 and arrowhead 310 contains open end 322 operative to receive shank 313 via hole 323. Such reverse configuration can allow for threading as well, such as via shank 313 being threaded.

Note that in such reverse configuration such coupling can occur in other ways, such as fastening, mating, pressure, magnets, adhesives, and so forth.

Figure 4:
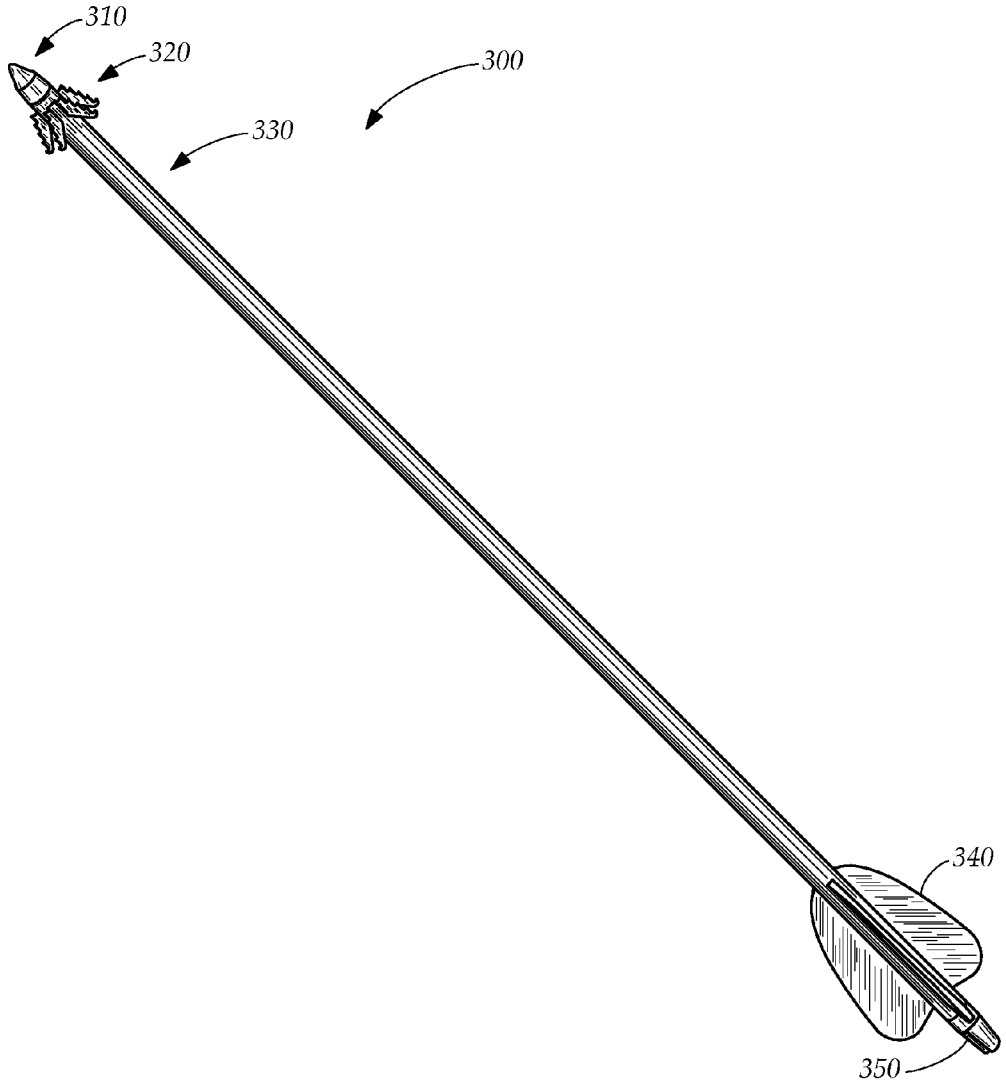
FIG. 4 shows a perspective view of an example embodiment of an assembled arrow with an arrow accessory according to the present disclosure.

FIG. 4 shows a perspective view of an example embodiment of an assembled arrow with an arrow accessory according to the present disclosure. Some elements of this figure are described above. Thus, same and/or similar reference characters identify same and/or like components described above and any repetitive detailed description thereof will hereinafter be omitted or simplified in order to avoid complication.

Arrow 300 is shown assembled with arrowhead 310, accessory 320 and shaft 330. Note that arrow 300 includes at least one fletching 340 and a nock 350, any of which can be structured as disclosed herein. Alternatively, arrow 300 can lack fletching 340 and/or nock 350. Also note that skirt 13, fins 14 and spine 16 are positioned over shaft 300. Spine 16 is positioned further down over shaft 300 than skirt 13 is positioned over shaft 300.

In other embodiments, accessory 10, 200 and/or 320 can be manufactured via several methods. One examples of such manufacturing method of manufacturing is manual and/or automatic assembly. Another example of such manufacturing method is die-cutting, stamping, molding, 3-D printing and other similar methods, irrespective whether accessory 10, 200 and/or 320 is unitary and/or assembled and/or in any combination thereof.

Figure 5A:
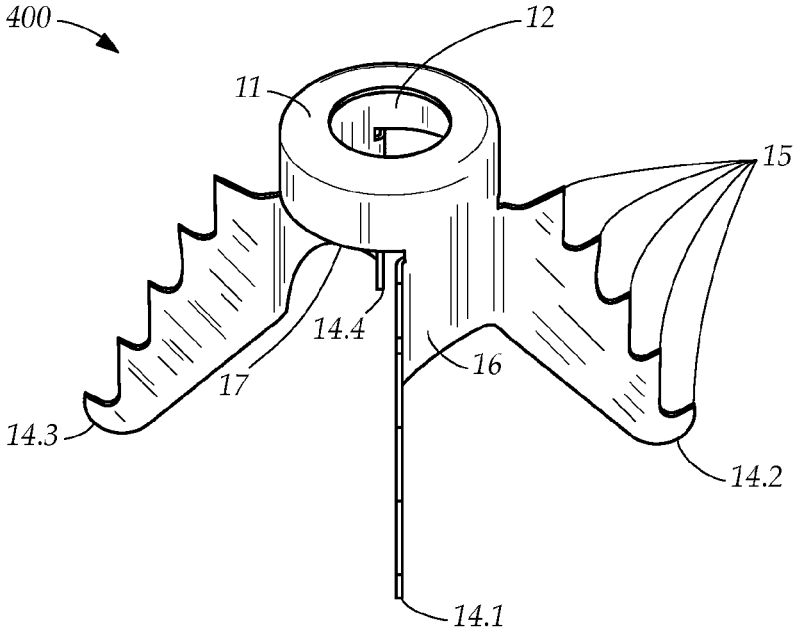
FIGS. 5A and 5B show a perspective view and a top view of an example embodiment of an arrow accessory having unparallel fins according to the present disclosure.
Figure 5B:
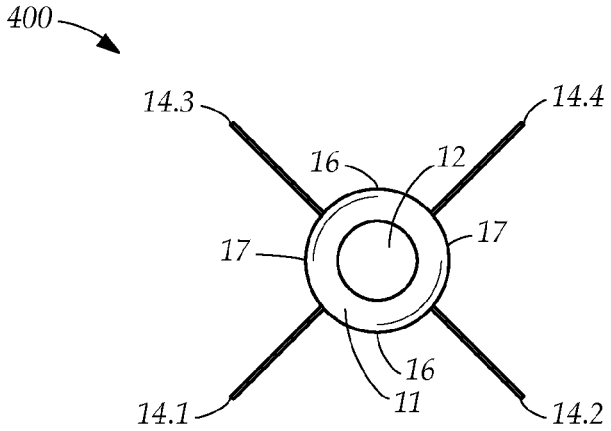

FIGS. 5A and 5B show a perspective view and a top view of an example embodiment of an arrow accessory having unparallel fins according to the present disclosure.

An accessory 400 can be similar in any manner to accessory 10 and/or 200. Accessory 400 includes fins 14 in a first fin set containing fins 14.1 and 14.2 and in a second set containing fins 14.3 and 14.4. Note that fins 14.1 and 14.2 are not parallel, such as via divergence. However, fins 14.1 and 14.2 can be not parallel via convergence as well. Similarly, note that fins 14.3 and 14.4 are not parallel, such as via divergence. However, fins 14.3 and 14.4 can be not parallel via convergence as well. Note that the unparallel alignment of fins 14.1 and 14.2 of the first set can be identical to and/or different from unparallel alignment of fins 14.3 and 14.4 of the second set. Note that although fins 14.1 and 14.4 can be coplanar, aligned, and/or parallel, in some example embodiments, fins 14.1 and 14.4 can be non-coplanar, non-aligned, and/or unparallel. Similarly, note that although fins 14.2 and 14.3 can be coplanar, aligned, and/or parallel, in some example embodiments, fins 14.2 and 14.3 can be non-coplanar, non-aligned, and/or unparallel. Note that any and/or all fins 14.1, 14.2, 14.3 and/or 14.4. can be aligned at any angle with respect to spine 16.

Figure 6A:
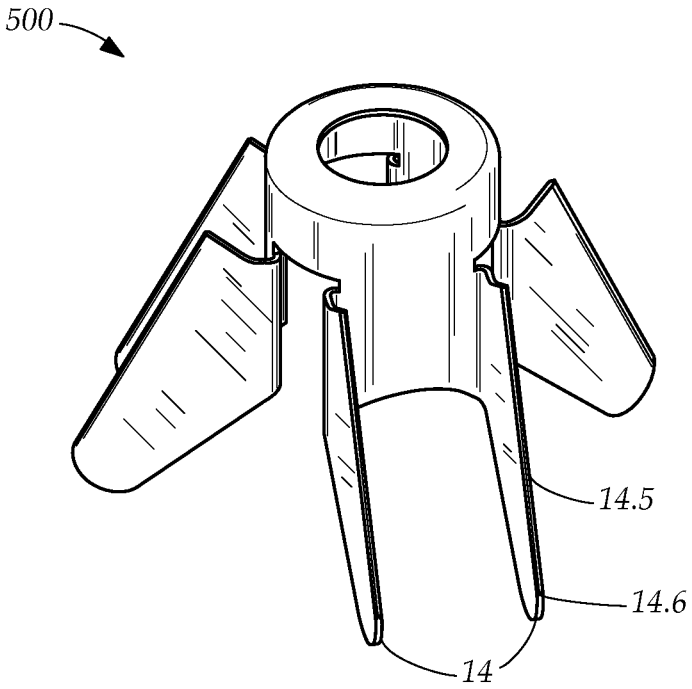
FIGS. 6A and 6B show a perspective view and a top view of an example embodiment of an arrow accessory having forward-facing smooth sharpened edges according to the present disclosure.
Figure 6B:
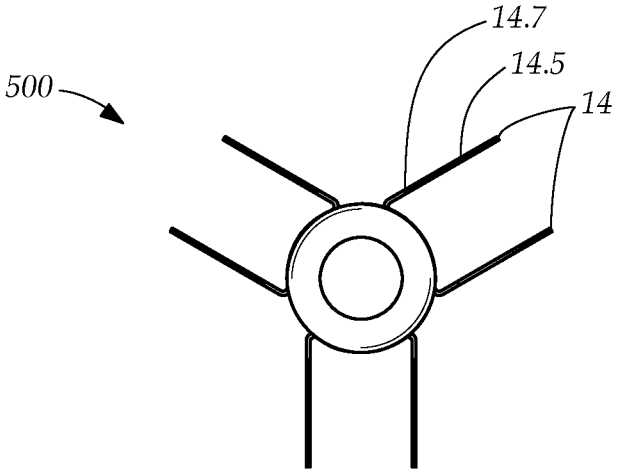

FIGS. 6A and 6B show a perspective view and a top view of an example embodiment of an arrow accessory having forward-facing smooth sharpened edges according to the present disclosure.

An accessory 500 can be similar in any manner to accessory 10, 400 and/or 200. Accessory 500 includes fins 14 with at least one containing a forward-facing smooth sharpened edge 14.5 extending from an upper edge portion 14.7 of fin 14 to a lower edge portion 14.6 of fin 14. Edge 14.5 can be linear, concave, convex, wavy, zigzag, and/or any combination thereof. Edge 14.5 can include a serrated and/or toothed portion. Edge 14.5 can be internal edge of fin 14, central edge of fin 14, and/or external edge of fin 14. In some example embodiments, edge 14.5 extends fully downward with portion 14.6 lacking. In some example embodiments, edge 14.5 extends fully upward with portion 14.7 lacking. In some example embodiments, portion 14.6 and portion 14.7 are lacking with edge 14.5 fully spanning along.

Figure 7A:
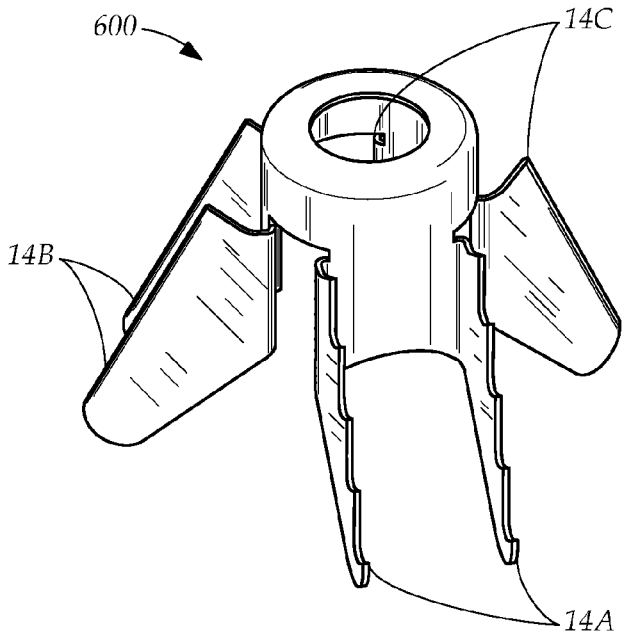
FIG. 7A shows a perspective view of an example embodiment of an arrow accessory having a first fin set with forward-facing serrated edges and a second fin set with forward-facing smooth sharpened edges according to the present disclosure.

FIG. 7A shows a perspective view of an example embodiment of an arrow accessory having a first fin set with forward-facing serrated edges and a second fin set with forward-facing smooth sharpened edges according to the present disclosure.

An accessory 600 can be similar in any manner to accessory 10, 400, 500 and/or 200. Accessory 600 includes a first fin set 14A with a plurality of forward-facing serrated edges and a second fin set 14B with a plurality of forward-facing smooth sharpened edges. Note that accessory 600 also includes a third fin set 14C, which can include a fin with at least one of a forward-facing serrated edge, a forward-facing dull edge and a forward facing smooth sharpened edge.

Figure 7B:
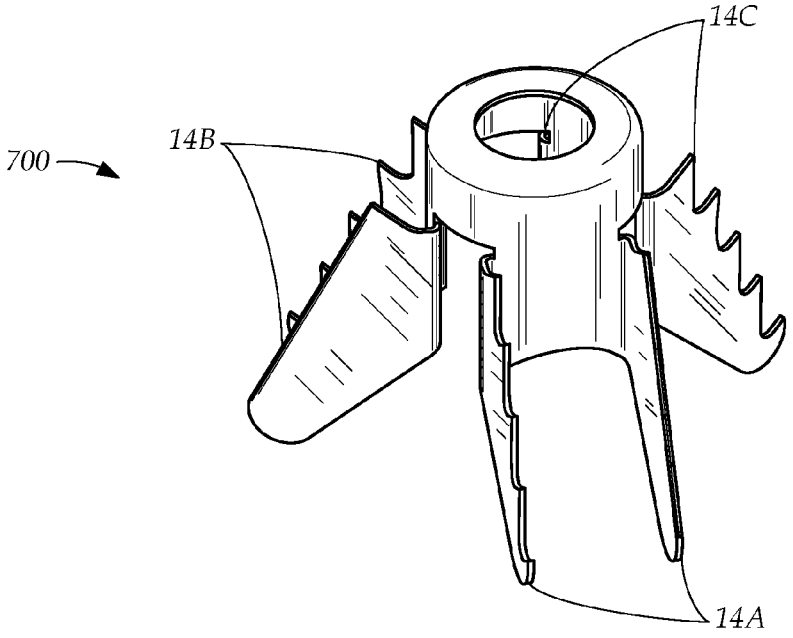
FIG. 7B shows a perspective view of an example embodiment of an arrow accessory having a fin set with a first fin having a forward-facing smooth sharpened edge and a second fin having a forward-facing serrated edge according to the present disclosure.

FIG. 7B shows a perspective view of an example embodiment of an arrow accessory having a fin set with a first fin having a forward-facing smooth sharpened edge and a second fin having a forward-facing serrated edge according to the present disclosure.

Note that each of set 14A and 14B includes a first fin having a forward-facing smooth sharpened edge and a second fin having a forward-facing serrated edge. Note that fin structure can alternate, differ and/or remain identical in any way among fin sets. For example, a forward-facing smooth sharpened edge and a forward-facing serrated edge in set 14A and then a forward-facing smooth sharpened edge and a forward-facing serrated edge in set 14B such that the serrated edge of set 14A is proximal to the smooth edge of set 14B. Also for example, a forward-facing smooth sharpened edge and a forward-facing serrated edge in set 14A and then a forward-facing serrated edge and a forward-facing smooth sharpened edge in set 14B such that that the serrated edge of set 14A is proximal to the serrated edge of set 14B. Note that set 14C can be identical to and/or different from at least one of set 14A and 14B in any manner.

Figure 8A:
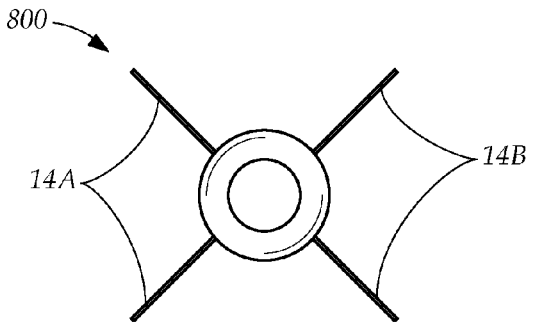
FIGS. 8A, 8B, and 8C show a plurality of top views of a plurality of example embodiments of a plurality of arrow accessories each having a fin set with its fins spaced apart from each other such that the fins are at most about 90 degrees from each other according to the present disclosure.
Figure 8B:
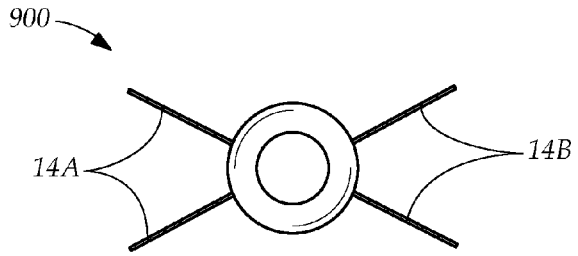
Figure 8C:
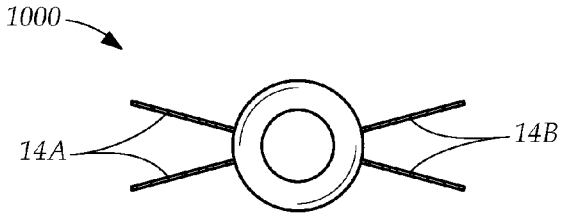

FIGS. 8A, 8B, and 8C show a plurality of top views of a plurality of example embodiments of a plurality of arrow accessories each having a fin set with its fins spaced apart from each other such that the fins are at most about 90 degrees from each other according to the present disclosure.

Note that fins within each of sets 14A and 14B are at most 90 degrees from each other. For example, in FIG. 8A, within each of sets 14A and 14B, the fins are 90 degrees from each other. For example, in FIGS. 8B and 8C, within each of sets 14A and 14B, the fins are less than 90 degrees from each other.

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of this application.

What is claimed is:

1. A device for use in archery, said device comprising:

a cap defined via a plate and a skirt depending from said plate, said plate having a hole therethrough, said hole sized such that a coupling shank is able to pass therethrough;

a spine depending from said skirt;

a fin extending from said spine.

2. The device of claim 1, wherein said fin includes a forward-facing toothed edge.

3. The device of claim 1, wherein said fin includes a forward-facing smooth sharpened edge.

4. The device of claim 1, wherein said skirt, said spine, and said fin are fully unitary.

5. The device of claim 1, further comprising another fin extending from said spine, said fin and said another fin are parallel to each other.

6. The device of claim 1, further comprising another fin extending from said spine, said fin and said another fin are unparallel to each other.

7. The device of claim 1, further comprising another fin extending from said spine, said fin includes a forward-facing serrated edge and said another fin includes a forward-facing smooth sharpened edge.

8. A device for use in archery, said device comprising:

a cap defined via a plate and a skirt depending from said plate, said plate having a hole therethrough, said hole sized such that a coupling shank is able to pass therethrough;

a plurality of spines depending from said skirt;

a plurality of fin sets uniquely corresponding to said spines, said sets extending from said spines.

9. The device of claim 8, wherein one of said fin sets includes a fin having a forward-facing serrated edge.

10. The device of claim 8, wherein one of said fin sets includes a fin having a forward-facing smooth sharpened edge.

11. The device of claim 8, wherein said skirt, said spines, and said sets are fully unitary.

12. The device of claim 8, wherein one of said fin sets includes a plurality of fins parallel to each other.

13. The device of claim 8, wherein one of said fin sets includes a plurality of fins unparallel to each other.

14. The device of claim 8, wherein one of said fin sets includes a first fin having a forward-facing serrated edge and a second fin having a forward-facing smooth sharpened edge.

15. A method of manufacturing a device for use in archery, said method comprising:

defining a cap via a plate and a skirt depending from said plate, forming a hole through said plate, said hole sized such that a coupling shank is able to pass therethrough;

depending a spine from said skirt;

extending a fin from said spine.

16. The method of claim 15, further comprising: forming said to fin to include at least one of a forward-facing toothed edge and a forward-facing smooth sharpened edge.

17. The method of claim 15, wherein said skirt, said spine, and said fin are fully unitary after said defining, said forming, said depending, and said extending.

18. The method of claim 15, further comprising: extending another fin from said spine, said fin and said another fin are parallel to each other.

19. The method of claim 15, further comprising: extending another fin from said spine, said fin and said another fin are unparallel to each other.

20. The method of claim 15, further comprising: extending another fin from said spine, said fin includes a forward-facing serrated edge and said another fin includes a forward-facing smooth sharpened edge.

* * * * *